United States Patent [19]

Anderson et al.

[11] 4,150,987

[45] Apr. 24, 1979

[54] HYDRAZONE CONTAINING CHARGE TRANSPORT ELEMENT AND PHOTOCONDUCTIVE PROCESS OF USING SAME

[75] Inventors: Howard W. Anderson, Boulder; Michael T. Moore, Longmont, both of Colo.

[73] Assignee: International Business Machines Corporation, Armonk, N.Y.

[21] Appl. No.: 842,431

[22] Filed: Oct. 17, 1977

[51] Int. Cl.[2] ..... G03G 5/14; G03G 5/04

[52] U.S. Cl. ..... 96/1.5 R; 260/566 B

[58] Field of Search ..... 96/1.5; 260/566 B

[56] References Cited

U.S. PATENT DOCUMENTS

| | | | |
|---|---|---|---|
| 3,547,646 | 12/1970 | Hori et al. | 96/90 |
| 3,697,595 | 11/1972 | Clecak et al. | 260/566 B |
| 3,717,462 | 2/1973 | Negishi et al. | 96/1.5 |
| 3,765,884 | 10/1973 | Shea | 96/1.6 |
| 3,870,516 | 3/1975 | Smith et al. | 96/1.5 |
| 3,971,821 | 7/1976 | Baumann et al. | 260/566 B |
| 3,997,342 | 12/1976 | Bailey | 96/1.5 |
| 4,028,102 | 6/1977 | Rochlitz et al. | 96/1.5 |

FOREIGN PATENT DOCUMENTS

| | | | |
|---|---|---|---|
| 930988 | 7/1963 | United Kingdom | 96/1.5 |
| 1351129 | 4/1974 | United Kingdom | 96/1.5 |

*Primary Examiner*—Roland E. Martin, Jr.
*Attorney, Agent, or Firm*—Thomas W. O'Rourke; William N. Hogg; Robert E. Harris

[57] ABSTRACT

A process for electrophotographic reproduction, and a layered electrophotographic plate having a conventional charge generation layer and a p-type hydrazone containing charge transport layer, in which the surface of the charge transport layer is selectively discharged by actinic radiation as a result of the migration through the transport layer of charges generated in the charge generation layer as a result of the actinic radiation and injected into the transport layer, the hydrazone having the composition;

21 Claims, 4 Drawing Figures

HYDRAZONE CONTAINING CHARGE TRANSPORT ELEMENT AND PHOTOCONDUCTIVE PROCESS OF USING SAME

BACKGROUND OF THE INVENTION

1. Field of the Invention

This invention relates in general to electrophotographic reproduction, and in particular to electrophotographic reproduction utilizing hydrazone materials of the composition;

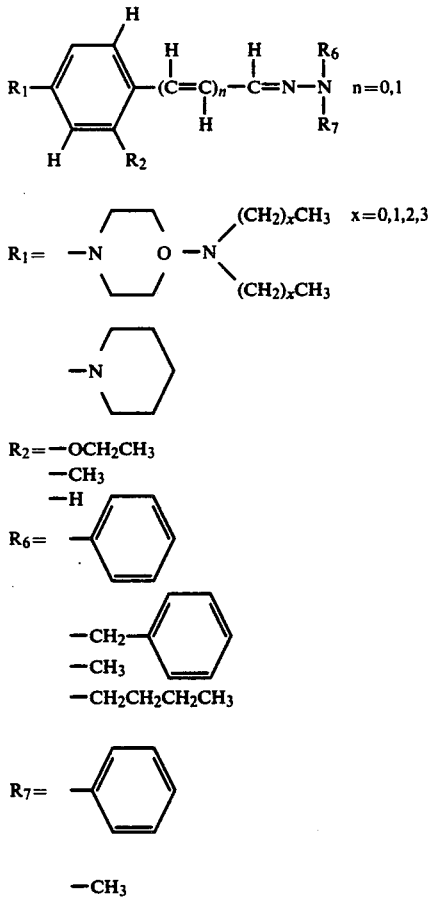

as the active material in the p-type charge transport layer of a multi-layer photoconductor system.

2. Description of the Prior Art

Electrophotographic processes and materials, such as xerography, are of course well known. Fundamentally, such processes involve the formation of a uniform electrostatic charge upon a normally insulating plate or element under "dark" conditions. Thereafter, the element is exposed to light in an imagewise manner to render the light struck portions of the element conductive thereby permitting the electrostatic charge to be conducted from the surface of the element. Thus a latent image in the form of charged surface areas are formed on the portions of the surface not struck by light. The latent electrostatic image on the surface of the element is then typically developed by exposure to an oppositely charged powder, i.e., a toner which is held to the charged portion of the element by the affinity of the toner for the opposite charge. The discharged portion of the element displays no such affinity for the toner. The thus formed image of toner is thereafter transferred to another surface, such as paper, and adhered thereto by, for instance, pressure sensitive, heat sensitive, etc, adhesives admixed with the toner.

A particularly useful electrophotographic element is that in which a charge generation layer, which is responsive to actinic radiation to generate electron-hole pairs, is utilized in conjunction with a p-type charge transport layer adjacent thereto. Numerous charge generation layers responsive to selected actinic radiation are known. The charge transport layer is not responsive to actinic radiation under the operating conditions, but serves to transport the positive charge from the charge generation layer, to, depending upon the particular system involved, the surface of the negatively charged transport layer at which the image is formed, or alternatively, to a conductor in a positively charged system. U.S. Pat. No. 3,837,851 discusses an electrophotographic plate utilizing as the active material in the charge transport layer a tri-aryl pyrazoline compound.

Hydrazones of a differing nature than those with which the instant invention is concerned have been employed in photoconductors essentially as a material responsive to actinic radiation. U.S. Pat. No. 3,717,462, issued Feb. 20, 1973, discloses such use of a hydrazone compound. Other similar uses of hydrazone compounds, in general are to be found in U.S. Pat. No. 3,765,884.

In summary, the prior art has recognized the use of charge transport layers in conjunction with distinct charge generating layers, but has not suggested the use of hydrazones in general, and particularly the hydrazones of the instant invention, for use as the active material in a charge transport layer. On the other hand, hydrazones differing from the specific hydrazones of the instant invention have been employed as light responsive materials as opposed to charge transport materials.

SUMMARY OF THE INVENTION

The present invention, which provides a surprising and heretofore unavailable improvement in multilayer electrophotographic elements, comprises an element having, as its fundamental parts, a conductor, a charge generation layer, which is substantially conventional in nature, and a novel p-type charge transport layer adjacent thereto including, as the active material, a hydrazone having the general formula;

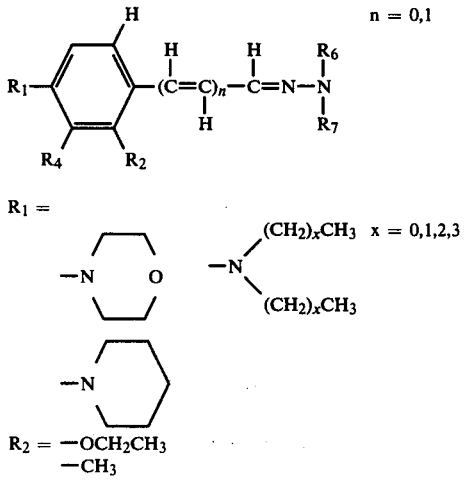

-continued

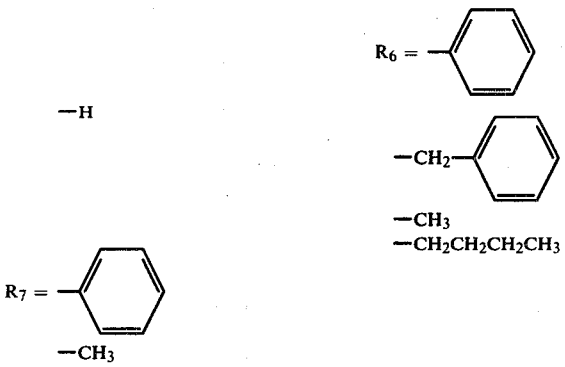

A particularly preferred charge transport material is p-diethylaminobenzaldehyde-(diphenylhydrazone), i.e.,

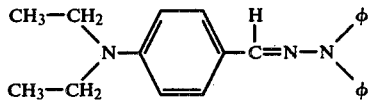

Other preferred charge transport materials are; o-ethoxy-p-diethylaminobenzaldehyde-(diphenylhydrazone), i.e.,

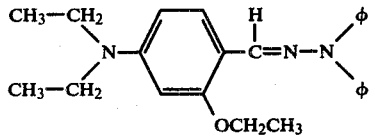

o-methyl-p-diethylaminobenzaldehyde-(diphenylhydrazone), i.e.,

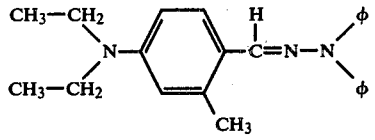

o-methyl-p-dimethylaminobenzaldehyde-(diphenylhydrazone), i.e.,

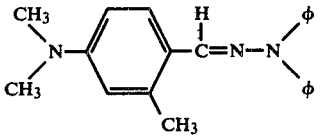

p-dipropylaminobenzaldehyde-(diphenylhydrazone), i.e.,

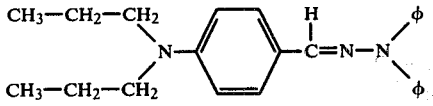

p-diethylaminobenzaldehyde-(benzylphenylhydrazone), i.e.,

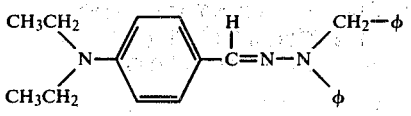

p-dibutylaminobenzaldehyde-(diphenylhydrazone), i.e.,

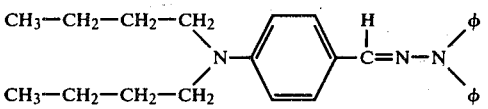

p-dimethylaminobenzaldehyde-(diphenylhydrazone), i.e.,

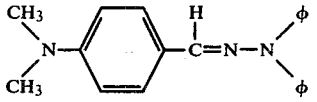

Multilayer electrophotographic elements are, in general, known. The charge generation layer, which may be organic or inorganic, is responsive to actinic radiation falling thereupon to generate an electron-hole pair. While the charge generation layer may be self-supporting, preferably a pliant support such as a polymeric film having a metalized surface is employed. Biaxially oriented polyethylene terephthalate is a preferred pliant support. As discussed above, the charge generation layer must be in electrical communication with a conductor to facilitate selective discharge of the element. Again with regard to the preferred but conventional aspect of the instant invention, an aluminized Mylar (polyethylene terephthalate film) is conveniently employed with the aluminum constituting the conducting layer. The charge generation layer is preferably formed on the support and in contact with the conducting layer. While not critical, the charge generation layer is generally between 0.05 microns to 0.20 microns thick. Inorganic charge generating materials include selenium, and tellurium. Organic charge generation materials including disazo compounds such as those described in U.S. patent application Ser. No. 129,635, now abandoned, and U.S. patent application Ser. No. 648,610 are generally operable. Useful results are obtainable with charge generating materials comprising methine dye derived from squaric acid. Materials of this type are discussed in U.S. patent application Ser. No. 323,678.

Chlorodiane Blue, methyl squarylium and hydroxy squarylium are particularly preferred charge generating materials.

More specifically, these preferred materials are; 4-4''[-(3,3'-dichloro-4,4'-biphenylylene)bis(azo)]-bis[3-hydroxy-2-naphthanilide], i.e.,

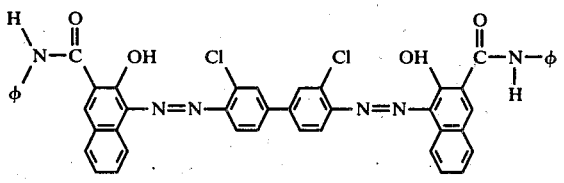

2,4-bis-(2-methyl-4-dimethylaminophenyl)-1,3-cyclobutadienediylium-1,3-diolate, i.e.,

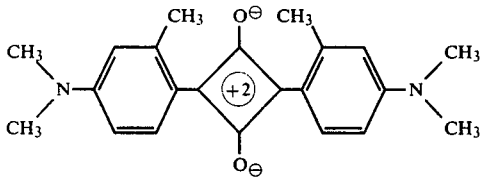

2,4-bis-(2-hydroxy-4-dimethylaminophenyl)-1,3-cyclobutadienediylium-1,3-diolate, i.e.,

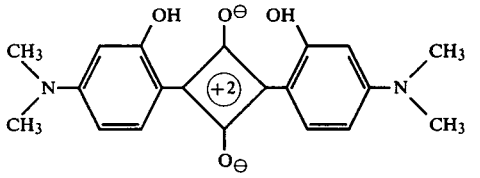

but will, for convenience, be hereafter identified as Chlorodiane Blue, methyl squarylium and hydroxy squarylium, respectively.

In summary, a broad range of inorganic and organic charge generation materials are operable with the charge transport material of the instant invention. However, since the charge transport material must, in most embodiments of the invention, be substantially transparent to the actinic radiation which activates the charge generation material, it is preferred that the charge generation material be responsive to actinic radiation in the visible light and longer wave lengths, i.e., longer than 3900 angstroms. This requirement is of concern in the preferred embodiment wherein the charge transport material is interposed between the charge generation material and the source of actinic radiation, i.e., as in a negative charging system. However, in a positive charging system, the charge generation material may be directly exposed to the actinic radiation and the charge transport material interposed between the charge generation material and the conductor. In the latter case, charge generation materials and actinic radiation sources operating at shorter than visible light wave lengths are suitable for use with the charge transport material of the instant invention.

In the preferred embodiment of the instant invention in which organic charge generation materials are employed, such materials are, as is conventional, coated onto the metalized support utilizing, for instance, meniscus coating, doctor blade coating or dip coating. Preferably, an adhesive layer is provided on the support to aid in bonding the charge generation layer thereto. Polyester resins are a preferred adhesive layer.

The novel charge transport layer according to the instant invention is preferably coated onto the charge generation layer to form the top or exposed layer of the element. Preferably, the charge transport layer is between 7 microns and 35 microns thick; but may be thicker, and operably may be less than 7 microns, i.e., 5 microns thick. Though the following discussion will primarily address this preferred embodiment, it is to be understood that, with regard to positive charging systems, the charge transport layer can be interposed between the charge generation layer and the support in the manner illustrated in the drawing and discussed below.

The active material of the p-type charge transport layer of the instant invention is a hydrazone of the generic structure;

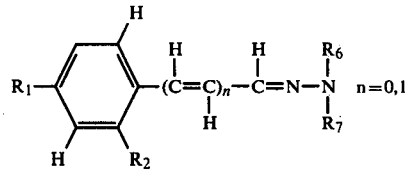

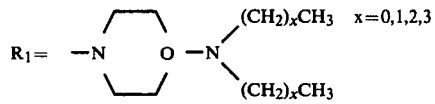

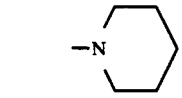

$R_2$ = $-OCH_2CH_3$
$-CH_3$
$-H$

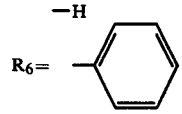

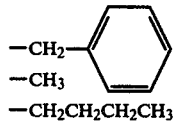

$R_6$ = $-CH_2CH_2CH_2CH_3$

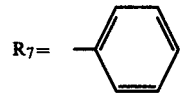

$R_7$ = $-CH_3$

A particularly preferred charge transport material is p-diethylaminobenzaldehyde-(diphenylhydrazone), i.e.,

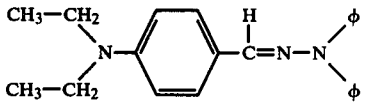

Other preferred charge transport materials are; o-ethoxy-p-diethylaminobenzaldehyde-(diphenylhydrazone), i.e.,

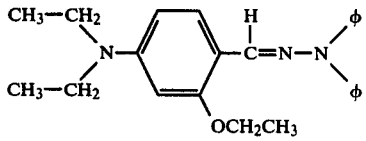

o-methyl-p-diethylaminobenzaldehyde-(diphenylhydrazone), i.e.,

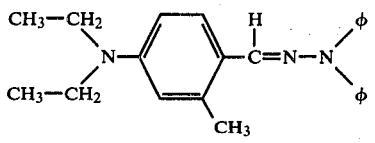

o-methyl-p-dimethylaminobenzaldehyde-(diphenylhydrazone), i.e.,

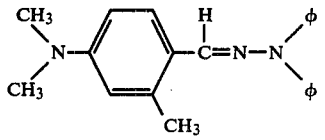

p-dipropylaminobenzaldehyde-(diphenylhydrazone), i.e.,

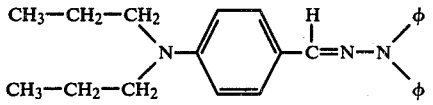

p-diethylaminobenzaldehyde-(benzylphenylhydrazone), i.e.,

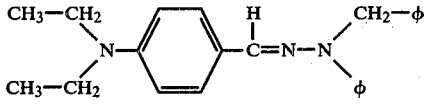

p-dibutylaminobenzaldehyde-(diphenylhydrazone), i.e.,

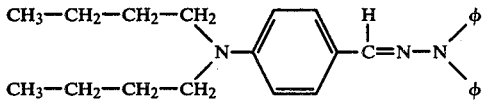

p-dimethylaminobenzaldehyde-(diphenylhydrazone), i.e.,

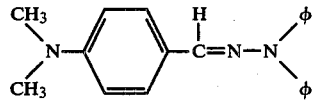

In use, the hydrazone material is admixed with a binder in an organic solvent, coated onto the charge generation layer and dried in a forced air oven. While numerous polymeric binders will be apparent to those skilled in the art, typical binders include polycarbonate resins, i.e., M-60 available from Mobay Chemical Company, polyester resins such as PE-200 available from Goodyear, and acrylic resins such as A-11 available from Rohm and Haas. Various other resins are also operable as will be demonstrated below. The resins, which may be used singularly or in combination, are admixed with an organic solvent or solvents, preferably tetrahydrofuran and toluene, though other appropriate solvents will be apparent to those skilled in the art.

Various other constituents for lubrication, stability, enhanced adhesion, coating quality, etc., may be included in the charge transport layer to accomplish purposes evident to those skilled in the art. For instance, a silicon oil, such as that available under the trademark DC-200 from Dow Corning, is included in the charge transport layer solution.

DETAILED DESCRIPTION OF THE DRAWINGS

Figure 1:
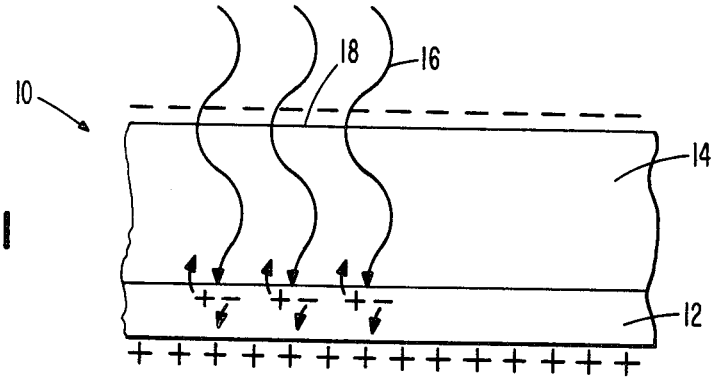
FIG. 1 is a simplified sectional view of the charge generation and charge transport layers of the preferred embodiment of the instant invention illustrating the response to exposure of a negatively charged element to actinic radiation.

Turning now to the drawing, wherein like components and constituents are designated by like reference numerals throughout the various figures, a multilayer electrophotographic element is depicted in FIG. 1 and generally designated by the reference numeral 10.

Figure 2:
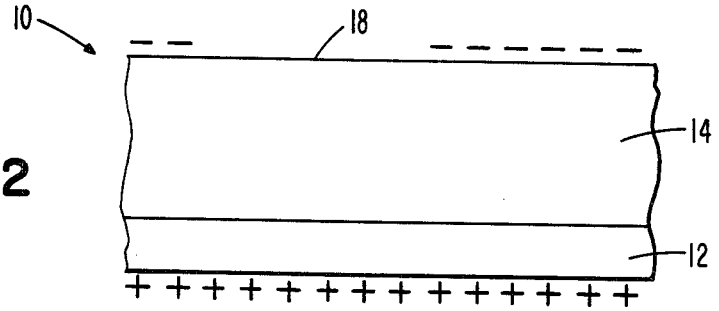
FIG. 2 is a view similar to that of FIG. 1 illustrating the resulting negative charge on the element surface.

Element 10 includes charge generation layer 12 and charge transport layer 14. As illustrated, a negative charge exists on the surface of charge transport layer 14. A positive charge is provided adjacent charge generation layer 12, i.e., in a conducting layer (not shown). Actinic radiation 16 is shown passing through charge transport layer 14 at area 18 and inducing charge generation layer 12 to produce the electron-hole pair charges. The hole is attracted to the negative charge on the surface of charge transport layer 14. Thus, as shown in FIG. 2, the hole is injected into and travels through charge transport layer 14 to discharge area 18. Charge transport layer 14 is essentially an insulating material relative to the negative charge thereon. Thus, localized discharge is maintained at area 18. The electron, of course, is attracted to the positive charge at the conducting layer (not shown).

Figure 3:
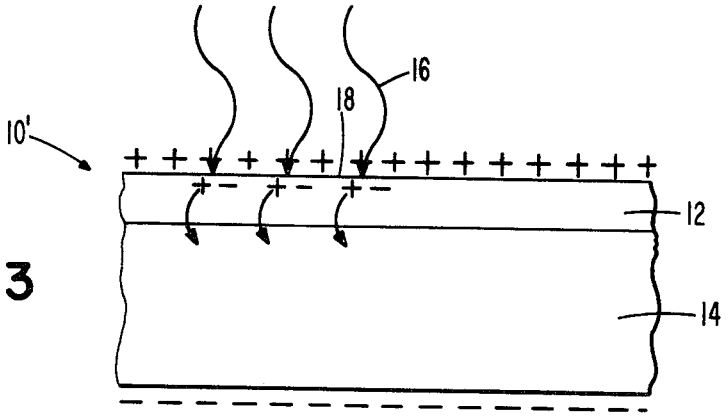
FIG. 3 is a view similar to that of FIG. 1 illustrating a positive charging element.
Figure 4:
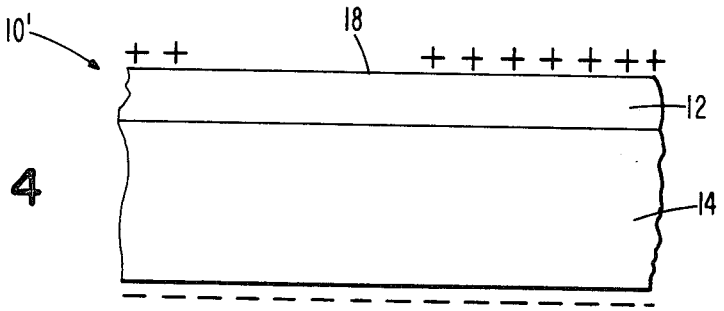
FIG. 4 is a view similar to that of FIG. 2 illustrating the resulting positive charge on the surface of the positive charged element.

A similar result is illustrated in FIG. 3 and FIG. 4. However, element 10', while including the same layers, is arranged differently. Charge generation layer 12 is positively charged and exposed directly to actinic radiation 16. Charge transport layer 14 is interposed between charge generation layer 12 and the negative charge, usually carried at a conductive layer (not shown). Again actinic radiation 16 develops electron-hole pair charges. Area 18 of charge generation layer 12 is discharged by the electrons while the corresponding holes pass through charge transport layer 14 in response to the attraction of the negative charges. Element 10' has the advantage of not requiring that actinic radiation 16 pass through charge transport layer 14, but charge generation layer 12 is not protected.

Other embodiments are contemplated but not illustrated. For instance, element 10 of FIG. 1 could be exposed to actinic radiation from the opposite side, i.e., through the conducting layer.

Detailed Examples of the Invention

The illustrative examples below are provided to permit those skilled in the art to practice the preferred embodiment of the instant invention as well as to illustrate the operable variations in the invention. However, it is not contemplated that the illustrative examples will extend to all operable combinations, or specify the various alternative components apparent to those skilled in the art.

EXAMPLE 1

A support appropriate for the instant invention was prepared by coating an aluminized Mylar (duPont Trademark for polyethylene terephthalate) substrate with a solution of polyester resin (PE 200 available from Goodyear) dissolved in tetrahydrofuran:toluene solvent system in a 9:1 ratio (0.7% to 1.4% solids, weight:-weight). The polyester coating was meniscus coated and dried in a forced air oven. Chlorodiane Blue (0.73% solids by weight) was then dissolved in 1.2:1.0:2.2 (by weight) mixture of ethylenediamine, n-butylamine and tetrahydrofuran. Silicon oil (available under the Trademark DC-200 from Dow Corning) was then added in the amount of 2.3% by weight relative to the Chlorodiane Blue. The resulting solution was meniscus coated onto the polyester coated substrate, and the resulting coated substrate dried in a forced air oven. Thus a relatively conventional Chlorodiane Blue charge generation layer was produced on an again conventional polyester support.

The novel charge transport layer of the instant invention was formed by admixing a polycarbonate resin binder (M-60 available from Mobay Chemical Company) in the amount of 7.65 grams, a polyester resin (PE-200 available from Goodyear) in the amount of 3.60 grams, and an acrylic resin (A-11 available from Rohm and Haas) in the amount of 2.25 grams in 86.5 grams of tetrahydrofuran and toluene solvent, the solvents being present in a ratio of approximately 9:1 by weight. A preferred hydrazone according to the instant invention, i.e., p-diethylaminobenzaldehyde-(diphenylhydrazone) was then added in the amount of 9.0 grams in conjunction with 0.02 grams of silicon oil (DC-200). Additional tetrahydrofuran may then be added to adjust the viscosity to that appropriate for the chosen coating technique. In the instant example, the resulting solution was meniscus coated onto the charge generation layer as formed above and the entire film again dried in a forced air oven to form a multilayered electrophotographic element. The electrophotographic element was tested by first charging the surface thereof to −870 volts in the dark, exposing the charged electrophotographic element to light typical of that utilized in commercial electrophotographic apparatus under various light intensity conditions, and determining the light intensity necessary to discharge the element to a voltage of −150 volts after 454 milliseconds under such conditions. It was determined that the element of the instant example required 1.10 microjoules per square centimeter for such discharge. Such value is indicative of excellent hole transport. Electrophotographic elements essentially identical to that of the instant examples were tested in commercially designed copying equipment and provided excellent results as to charge transport, resistance to toner filming, physical resistance to wear, long-term stability of electrical and physical properties, and low temperature operation.

EXAMPLE 2*a–f*

Multilayered electrophotographic elements similar to those of example 1 were prepared with varied transport layer resins in differing amounts.

| | Binder Resins | | |
|---|---|---|---|
| Example | M-60 (gms) | PE-200 (gms) | A-11 (gms) |
| 2a | 13.5 | 0 | 0 |
| 2b | 0 | 13.5 | 0 |
| 2c | 9.0 | 2.25 | 2.25 |
| 2d | 10.12 | 2.25 | 1.13 |
| 2e | 9.90 | 3.60 | 0 |
| 2f | 7.65 | 2.25 | 3.60 |

Testing in the manner set forth in Example 1 yielded the following results.

| Example | Discharge Response Time (milliseconds) | Dark Voltage | Discharge Voltage | Exposure Energy (microjoules/centimeter$^2$) |
|---|---|---|---|---|
| 2a | 454 | −870 | −150 | 1.38 |
| 2b | 454 | −870 | −190 | 1.34 |
| 2c | 454 | −870 | −150 | 1.10 |
| 2d | 454 | −870 | −150 | 1.15 |
| 2e | 454 | −870 | −150 | 1.10 |
| 2f | 454 | −870 | −150 | 1.03 |

EXAMPLE 3

A multilayered electrophotographic element similar to that of Example 1 was prepared with the exception that a transport layer solution containing 14.5 grams of acrylic resin (A-11) as the sole binder and 14.5 grams of p-diethylaminobenzaldehyde-(diphenylhydrazone) was employed. When tested as set forth in Example 1, 3.0 microjoules per square centimeter of light energy were required to discharge the element from a dark voltage of −870 volts to −150 volts at a discharge response time of 454 milliseconds.

EXAMPLE 4

A multilayered electrophotographic element similar to that of Example 1 was prepared with the exception that the acrylic resin employed was B-50, a proprietary resin available from Rohm and Haas, in place of the A-11 acrylic resin. When tested as set forth in Example 1, 1.16 microjoules per square centimeter of light energy were required to discharge the element from a dark voltage of −870 volts to −150 at a discharge response time of 454 milliseconds.

EXAMPLE 5*a–e*

Multilayered electrophotographic elements similar to that of Example 2*e* were prepared with the exception that the following polyester resins were substituted in the same amount for the PE200 polyester resin.

| Example | Polyester | |
|---|---|---|
| 5a | PE222 | (Goodyear) |
| 5b | 49000 | (duPont) |
| 5c | PE207 | (Goodyear) |
| 5d | VPE5545 | (Goodyear) |
| 5e | PE307 | (Goodyear) |

Results substantially similar to those of Example 2*e* were obtained in each instance.

EXAMPLE 6*a–k*

Multilayered electrophotographic elements similar to that of Example 1 were prepared with the exception that the initial adhesive coatings were prepared with the following resins in place ot the polyester (PE200) in similar amounts. Each element was charged to −870 volts and discharged to −150 volts in 146 milliseconds. The indicated light energy in microjoules per square centimeter was required.

| Example | Trademark | Resin | Exposure Energy |
|---|---|---|---|
| 6a | PE 222 | polyester | 1.14 |
| 6b | PE 207 | polyester | 1.28 |
| 6c | 49000 | polyester | 1.28 |
| 6d | A-11 | acrylic | 1.34 |
| 6e | B-66 | acrylic | 1.51 |
| 6f | M-60 | polycarbonate | 1.48 |
| 6g | | polysulfone | 1.36 |
| 6h | 15/95S | formvar | 1.28 |
| 6i | B-72A | butvar | 1.22 |
| 6j | B-76 | formvar | 1.26 |
| 6k | | polyvinyl carbazole | 1.23 |

EXAMPLE 7*a* and 7*b*

Multilayer electrophotographic elements similar to that of example 2*e* were prepared with the exception that 5.78 grams of p-diethylaminobenzaldehyde-(diphenylhydrazone) were substituted in the transport layer solution in Example 7*a*, and 7.27 grams were similarly substituted in Example 7*b*. When tested under the same discharge voltage and discharge response time as in Example 1, it was found that the element of Example 7*a* required 1.4 microjoules per square centimeter of light energy and that of Example 7*b* required 1.3 microjoules per square centimeter of light energy.

EXAMPLE 8

A multilayered electrophotographic element similar to that of Example 2*a* was prepared with the exception that 13.5 grams of p-diethylaminobenzaldehyde-(diphenylhydrazone) was employed in the charge transport layer solution. When tested as set forth in Example 1, 1.37 microjoules per square centimeter of light energy were required to discharge the element from a dark voltage of −870 volts to −150 volts at a discharge response time of 146 milliseconds.

EXAMPLE 9

A multilayered electrophotographic element similar to that of Example 2*a*was prepared with the exception that 20.25 grams of p-diethylaminobenzaldehyde-(diphenylhydrazone) was employed in the charge transport layer solution. When tested as set forth in Example 1, 1.37 microjoules per square centimeter of light energy were required to discharge the element from a dark voltage of −870 volts to −150 volts at a discharge response time of 146 milliseconds.

EXAMPLE 10 *a–d*

Multilayered electrophotographic elements were prepared similar to that of Example 2*a* with the exception that the following alternative hydrazone compounds were employed in the same quantity in the charge transport solution.

EXAMPLE

10*a*—o-methyl-p-dimethylaminobenzaldehyde-(diphenylhydrazone)

10*b*—o-ethoxy-p-diethylaminobenzaldehyde-(diphenylhydrazone)

10*c*—o-methyl-p-diethylaminobenzaldehyde-(diphenylhydrazone)

10*d*—p-dimethylaminobenzaldehyde-(diphenylhydrazone)

The following results were obtained.

| Example | Discharge Response Time (milliseconds) | Dark Voltage | Discharge Voltage | Exposure Energy (microjoules/ centimeter$^2$) |
|---|---|---|---|---|
| 10a | 146 | −800 | −190 | 1.71 |
| 10b | 146 | −800 | −190 | 1.24 |
| 10c | 146 | −800 | −190 | 1.64 |
| 10d | 146 | −800 | −190 | 1.65 |

EXAMPLE 11*a–c*

Multilayered electrophotographic elements were prepared similar to that of Example 2*a* with the exception that 13.5 grams of the following hydrazones were employed in the transport layer solution.

Example

11*a*—o-methyl-p-dimethylaminobenzaldehyde-(diphenylhydrazone)

11*b*—o-ethoxy-p-diethylaminobenzaldehyde-(diphenylhydrazone)

11*c*—o-methyl-p-diethylaminobenzaldehyde-(diphenylhydrazone)

The following results were obtained.

| Example | Discharge Response Time (milliseconds) | Dark Voltage | Discharge Voltage | Exposure Energy (microjoules/ centimeter$^2$) |
|---|---|---|---|---|
| 11a | 146 | −870 | −150 | 1.56 |
| 11b | 146 | −870 | −150 | 1.21 |
| 11c | 146 | −870 | −150 | 1.60 |

EXAMPLE 12*a–c*

Multilayered electrophotographic elements were prepared similar to that of Example 1 with the exception that the transport layer solution contained 6.75 grams of polyester resin (PE200), 6.75 grams of polycarbonate resin (M60) and 13.5 grams of the following hydrazone compounds;

Example

12*a*—p-dimethylaminobenzaldehyde-(diphenylhydrazone)

12*b*—p-dipropylaminobenzaldehyde-(diphenylhydrazone)

12*c*—p-dibutylaminobenzaldehyde-(diphenylhydrazone)

The following results were obtained.

| Example | Discharge Response Time (milliseconds) | Dark Voltage | Discharge Voltage | Exposure Energy (microjoules/ centimeter$^2$) |
|---|---|---|---|---|
| 12a | 146 | −800 | −190 | 1.81 |
| 12b | 146 | −800 | −190 | .92 |
| 12c | 146 | −800 | −190 | 1.51 |

EXAMPLE 13

In a manner generally similar to that of Example 1, hydroxy squarylium in the amount of 1 gram in a solvent mixture of 1 milliliter of ethylenediamine, 5 milliliters propylamine, and 24 milliliters of tetrahydrofuran was meniscus coated on an aluminized polyester substrate (Mylar) to form a charge generation layer and dried. A novel transport layer in accord with the instant invention was formed by meniscus coating a solution of polycarbonate resin (M60) in the amount of 8.12 grams and 8.12 grams of p-diethylaminobenzaladehyde-(diphenylhydrazone) in a 9:1 mixture of tetrahydrofuran and toluene on the coated support and drying to form a multilayered electrophotographic element. When tested as set forth in Example 1, 1.40 microjoules per square centimeter of light energy were required to discharge the element from a dark voltage of −870 volts to −150 volts at a discharge response time of 146 milliseconds.

EXAMPLE 14

A multilayered electrophotographic element similar to that of Example 13 was prepared with the exception that o-ethoxy-p-diethylaminobenzaldehyde-(diphenylhydrazone) was employed in the transport layer solution. When tested as set forth in Example 1, 1.02 microjoules per square centimeter of light energy were required to discharge the element from a dark voltage of −870 volts to −150 volts at a discharge response time of 146 milliseconds.

EXAMPLE 15

A multilayered electrophotographic element similar to that of Example 13 was prepared with the exception that the charge generation layer solution contained 0.85 grams of hydroxy squarylium and 0.15 grams of methyl squarylium. When tested as set forth in Example 1, 0.86 microjoules per square centimeter of light energy were required to discharge the element from a dark voltage of −870 volts to −150 volts at a discharge response time of 146 milliseconds.

EXAMPLE 16

A multilayered electrophotographic element similar to that of Example 13 was prepared with the exception that the charge generation solution contained 0.85 grams of hydroxy squarylium and 0.15 grams of methyl squarylium, and the charge transport layer solution contained 8.12 grams of polycarbonate resin (M60) and 5.42 grams of p-diethylaminobenzaldehyde-(diphenylhydrazone). When tested as set forth in Example 1, 1.10 microjoules per square centimeter of light energy were required to discharge the element from a dark voltage of −870 volts to −150 volts at a discharge response time of 146 milliseconds.

EXAMPLE 17

A multilayered electrophotographic element was prepared by coating onto a charge generation layer (formed of vacuum deposited selenium and tellurium) a charge transport layer from a solution of 6.75 grams of polyester resin (PE200), 6.75 grams of polycarbonate resin (M 60) and 13.5 grams of p-diethylaminobenzaldehyde-(diphenylhydrazone). When tested as set forth in Example 1, 2.0 microjoules per square centimeter of light energy were required to discharge the element from a dark voltage of −800 volts to −300 volts at a discharge response time of 454 milliseconds.

From the above examples, it is apparent that the p-type charge transport system of the instant invention is operable with varying types of resin binders as well as a substantial number of hydrozone compounds of the designated type. Both organic and inorganic charge generation layers are suitable for use with the charge generation layer of the instant invention, and various combinations of solvents, polymeric binders etc. may be employed as is known in the art. When used in relatively high concentrations, certain of the hydrazones display a tendency to crystallize, thereby degrading the charge transport function. However, when lesser amounts are used, operable results are obtainable. Such adjustment will be readily accomplished by those skilled in the art.

The electrophotographic elements utilizing the charge transport layer in accord with the instant invention display an excellent balance between sensitivity, particularly at low temperatures, adhesion to adjacent layers and resistance to physical wear again at varying temperatures. The elements have been found to age well and display remarkable resistance to toner filming.

Although in view of the wide usage to which the present invention can be put, only limited embodiments of the invention have been described for purposes of illustration, it is, however, anticipated that various changes and modifications will be apparent to those skilled in the art, and that such changes and modifications may be made without departing from the scope of the invention as defined by the following claims.

What is claimed is:

1. A electrophotographic element comprising;

an electrically conductive layer;

a charge generation layer responsive to actinic radiation to generate an electron-hole pair; and a p-type charge transport layer adjacent the charge generation layer, the charge transport layer comprising a hydrazone of the composition;

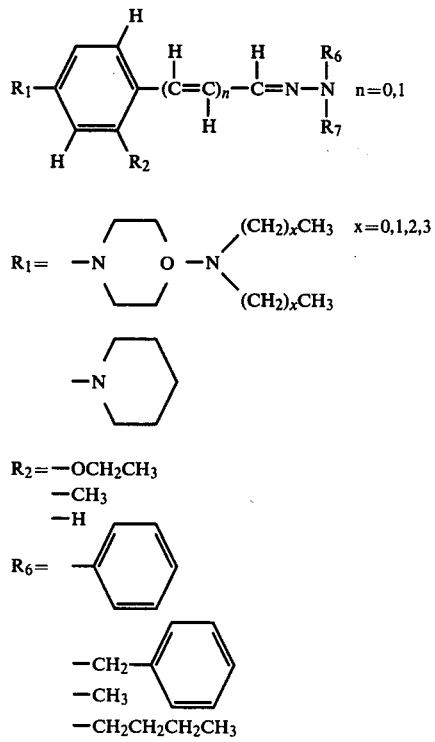

-continued $R_7$= 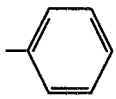

$-CH_3$ and a polymeric binder;

whereby holes generated by photoelectric phenomenon in the charge generation layer may be transported through the charge transport layer to facilitate localized selective discharge of charged surfaces of the element.

2. An electrophotographic element as set forth in claim 1 in which the p-type charge transport layer comprises a hydrazone selected from the group consisting of p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), and p-dimethylaminobenzaldehyde-(diphenylhydrazone).

3. An electrophotographic element as set forth in claim 1 in which the p-type charge transport layer includes p-diethylaminobenzaldehyde-(diphenylhydrazone).

4. An electrophotographic element as set forth in claim 1 in which the charge generation layer is positioned between the electrically conductive layer and the p-type charge transport layer, with the p-type charge transport layer forming an exposed surface of the electrophotographic element.

5. An electrophotographic element as set forth in claim 1 in which the charge generation layer is responsive to actinic radiation of a wave length greater than 3,900 angstroms to generate an electron-hole pair.

6. An electrophotographic element as set forth in claim 1 in which the charge generation layer is of a thickness between 0.05 microns to 0.2 microns, and the p-type charge transport layer is at least 5 microns thick.

7. An electrophotographic element as set forth in claim 6 in which the p-type charge transport layer is between 7 and 35 microns thick.

8. An electrophotographic element as set forth in claim 1 in which the charge generaton layer comprises a lenium and its alloys, tellurium and its alloys, disazo compounds, and methine dyes derived from squaric acid.

9. An electrophotographic element as set forth in claim 8 in which the photoconductive material selected from the group consisting of Chlorodiane Blue, methyl squarylium and hydroxy squarylium.

10. An electrophotographic element as set forth in claim 1 in which the polymeric binder is selected from the group consisting of polycarbonate resins, polyester resins, acrylic resins, and mixtures thereof.

11. An electrophotographic element comprising, in successive layers;

a conductive substrate;

a charge generation layer responsive to actinic radiation of a wave length greater than 3,900 angstroms to generate an electron-hole pair, the charge generation layer including a photoconductor selected from the group consisting of Chlorodiane Blue, methyl squarylium and hydroxy squarylium; and a p-type charge transport layer, the charge transport layer being comprised of a hydrazone of the composition;

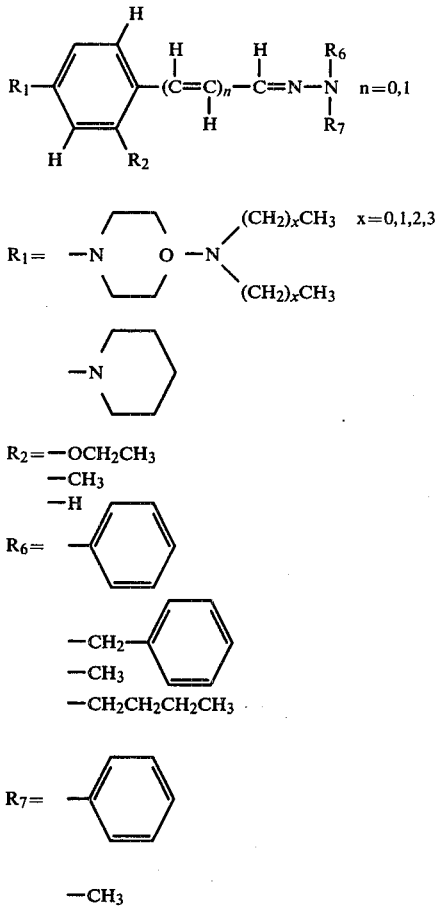

and a polymeric binder.

12. An electrophotographic element as set forth in claim 11 in which the p-type charge transport layer comprises a hydrazone selected from the group consisting of p-diethylaminobenzaldehyde-(diphenylhydrazone), o-ethoxy-p-diethylaminobenzaldehyde-(diphenylhydrazone), o-methyl-p-diethylaminobenzaldehdye-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), and p-dibutylaminobenzaldehyde-(diphenylhydrazone).

13. An electrophotographic element as set forth in claim 11 in which the polymeric binder is selected from the group consisting of polycarbonate resins, polyester resins, acrylic resins, and mixtures thereof.

14. A method for forming an electrophotographic image comprising the steps of;

electrostatically charging in the dark the surface of an electrophotographic plate comprising; a conductive substrate, a charge generation layer responsive to actinic radiation to generate an electron-hole pair, and a p-type charge transport layer adjacent the charge generation layer, the charge transport layer comprising a hydrazone of the composition;

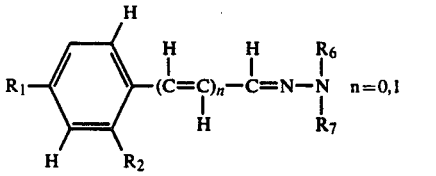

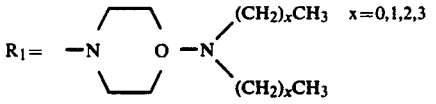

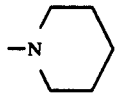

$R_2$ = —$OCH_2CH_3$
—$CH_3$
—H

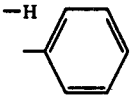

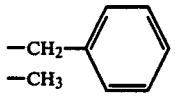

—$CH_2CH_2CH_2CH_3$

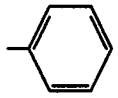

—$CH_3$ and a polymeric binder;

exposing the electrophotographic element to an image-wise pattern of actinic radiation; and discharging the surface of the electrophotographic element in an image-wise fashion corresponding to the pattern of the actinic radiation to produce a latent electrostatic image thereon;

whereby an electron-hole pair is generated in the charge generation layer at the portion struck by the actinic radiation and the hole is injected into the charge transport layer to discharge the surface of the electrophotographic element.

15. An electrophotographic process as set forth in claim 14 in which the charge generation layer is positioned between the conductive substrate and the charge transport layer and in electrical contact with each, the charge transport layer has an exposed surface layer which is initially negatively charged, and the actinic radiation passes through the charge transport layer to strike the charge generation layer, whereby the resulting holes are injected into and transported through the charge transport layer to discharge negative charges on the surface of the charge transport layer thus producing the latent electrostatic image.

16. An electrophotographic process as set forth in claim 14 in which the charge transport layer is interposed between the charge generation layer and the conductive substrate, and the charge generation layer is positively charged, whereby holes generated as a result of actinic radiation striking the charge generation layer are injected into and transported through the charge transport layer to the conductive substrate while electrons discharge the surface of the charge generation layer to produce the electrostatic image.

17. An electrophotographic process as set forth in claim 14 in which the p-type charge transport layer comprises a hydrazone selected from the group consisting of p-diethylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), and p-dimethylaminobenzaldehyde-(diphenylhydrazone).

18. An electrophotographic process as set forth in claim 14 in which p-type charge transport layer includes p-diethylaminobenzaldehyde-(diphenylhydrazone).

19. An electrophotographic element as set forth in claim 14 in which the charge generation layer includes a photoconductor selected from the group consisting of selenium and its alloys, tellurium and its alloys, disazo compounds, and methine dyes derived from squaric acid.

20. An electrophotographic process as set forth in claim 19 in which the photoconductive material is selected from the group consisting of Chlorodiane Blue, methyl squarylium and hydroxy squarylium.

21. An electrophotographic process comprising;

negatively charging in the dark the surface of an electrophotographic element comprising in ordered layers; a conductive substrate, a charge generation layer responsive to actinic radiation to generate an electron hole pair and including a photoconductive material selected from the group consisting of Chlorodiane Blue, methyl squarylium and hydroxy squarylium, and a p-type charge transport layer including p-diethylaminobenzaldehyde-(diphenylhydrazone) and a polymeric binder;

exposing the electrophotographic element to an image-wise pattern of actinic radiation; and discharging the negative charge in the image-wise pattern corresponding to the pattern of the actinic radiation by combining the hole transported through the charge transport layer and a localized negative charge to produce an electrostatic image at the surface of the electrophotographic element.

* * * * *

UNITED STATES PATENT OFFICE

CERTIFICATE OF CORRECTION

PATENT NO. : 4,150,987

DATED : April 24, 1979

INVENTOR(S) : Anderson et al

It is certified that error appears in the above-identified patent and that said Letters Patent are hereby corrected as shown below:

Column 4, lines 56 through 58, "4-4"[-(3,3'-dichloro-4,4'-biphenylylene) bis(azo)]-bis[3-hydroxy-2-naphthanilide]"

should be -- 4-4"-[(3,3'-dichloro-4,4'-biphenylyene)bis(azo)]-bis[3-hydroxy-2-naphthanilide] --

Claim 8, line 51, after "a" insert -- photoconductor selected from the group consisting of se- --

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*